US009289769B2

(12) United States Patent
Link et al.

(10) Patent No.: US 9,289,769 B2
(45) Date of Patent: Mar. 22, 2016

(54) COVER FOR SAMPLE WITH SAMPLE-SIZE INDEPENDENT HEIGHT ADJUSTMENT

(75) Inventors: Holger Link, Hamburg (DE); Jens Peter Kroog, Grosshansdorf (DE); Lutz Timmann, Fuhlendorf (DE)

(73) Assignee: Eppendorf AG, Hamburg (DE)

( * ) Notice: Subject to any disclaimer, the term of this patent is extended or adjusted under 35 U.S.C. 154(b) by 538 days.

(21) Appl. No.: 12/030,136

(22) Filed: Feb. 12, 2008

(65) Prior Publication Data

US 2008/0280330 A1 Nov. 13, 2008

Related U.S. Application Data

(60) Provisional application No. 60/889,621, filed on Feb. 13, 2007.

(30) Foreign Application Priority Data

Feb. 13, 2007 (EP) ..... 07003049

(51) Int. Cl.
*B01L 7/00* (2006.01)

(52) U.S. Cl.
CPC ..... *B01L 7/52* (2013.01); *B01L 2200/023* (2013.01); *B01L 2300/046* (2013.01); *B01L 2300/1822* (2013.01); *B01L 2300/1827* (2013.01)

(58) Field of Classification Search
CPC ..... B01L 7/52
USPC ..... 435/287.2
See application file for complete search history.

(56) References Cited

U.S. PATENT DOCUMENTS

| | | | | |
|---|---|---|---|---|
| 4,096,965 | A | 6/1978 | Lessnig et al. | |
| 5,056,427 | A | 10/1991 | Sakabe | |
| 5,475,610 | A | 12/1995 | Atwood et al. | |
| 5,575,610 | A | 11/1996 | Soyama | |
| 5,851,492 | A | 12/1998 | Blattner et al. | |
| 6,153,426 | A * | 11/2000 | Heimberg | 435/287.2 |
| 6,197,572 | B1 | 3/2001 | Schneebeli | |

(Continued)

FOREIGN PATENT DOCUMENTS

| | | |
|---|---|---|
| CA | 2610732 | 12/2006 |
| DE | 20117661 U1 | 4/2003 |

(Continued)

OTHER PUBLICATIONS

Chapter 9 ("Gehemme und Gesperre") of "Konstrucktionselemente der Feinmechanik" 9Ed.: Werner Krause; ISBN: 3-341-00461-0), pp. 445-460 (English Translation).

(Continued)

*Primary Examiner* — Jonathan Hurst
(74) *Attorney, Agent, or Firm* — Arnold & Porter LLP; Todd A. Lorenz

(57) ABSTRACT

The present invention relates to a device and a method for controlling the temperature of at least one sample. The device comprises at least the following means: (a) means for accommodating at least one sample; (b) means for heating and/or cooling at least one sample; (c) means for covering at least one sample. These means for covering at least one sample comprise at least one movable contact area and first and second means for fixating said at least one movable contact area in at least one defined direction relative to the sample. Therein said first means for fixating matingly engages with a corresponding second means for fixating.

10 Claims, 5 Drawing Sheets

(56) References Cited

U.S. PATENT DOCUMENTS

| | | | | |
|---|---|---|---|---|
| 6,518,060 | B2 | 2/2003 | Heimberg et al. | |
| 6,556,940 | B1 * | 4/2003 | Tretiakov et al. | 702/130 |
| 6,677,151 | B2 | 1/2004 | Sandell | |
| 6,703,236 | B2 | 3/2004 | Atwood | |
| 6,730,883 | B2 | 5/2004 | Brown et al. | |
| 2002/0028507 | A1 * | 3/2002 | Heimberg et al. | 435/305.3 |
| 2005/0226782 | A1 | 10/2005 | Reed et al. | |

FOREIGN PATENT DOCUMENTS

| | | | |
|---|---|---|---|
| EP | 0388159 | A2 | 9/1990 |
| EP | 0955097 | A1 | 11/1999 |
| EP | 1013342 | A2 | 6/2000 |
| EP | 1045038 | A | 10/2000 |
| WO | WO 03059517 | A2 | 7/2003 |
| WO | WO 2006002226 | A1 | 1/2006 |
| WO | WO 2006133750 | | 12/2006 |

OTHER PUBLICATIONS

Examination Report, Australian Patent Office, regarding Singapore Patent Application No. SG 200801182, held in the name of Eppendorf AG (DE), mailed Jan. 15, 2010.

Search Report and Written Opinion, Australian Patent Office, regarding Singapore Patent Application No. SG 200801182, held in the name of Eppendorf AG (DE), mailed Apr. 7, 2009.

Extended European Search Report, European Patent Office, regarding European Patent Application No. 07003050, held in the name of Eppendorf AG (DE), mailed Jul. 6, 2007.

Examination Report, European Patent Office, regarding European Patent Application No. 07003050, held in the name of Eppendorf AG (DE), mailed Sep. 20, 2010.

Extended European Search Report, European Patent Office, regarding European Patent Application No. 07003049, held in the name of Eppendorf AG (DE), mailed Jul. 4, 2007.

Examination Report, European Patent Office, regarding European Patent Application No. 07003049, mailed Sep. 20, 2010.

Examination Report, Australian Patent Office, regarding Singapore Patent Application No. SG 200801180, held in the name of Eppendorf AG (DE), mailed Sep. 8, 2010.

Written Opinion and International Search Report, Australian Patent Office, regarding Singapore Patent Applicaton No. 200801180, held in the name of Eppendorf AG (DE), mailed Feb. 19, 2009.

Written Opinion, Australian Patent Office, regarding Singapore Application No. 200801180, held in the name of Eppendorf AG (DE), mailed Nov. 25, 2009.

* cited by examiner

COVER FOR SAMPLE WITH SAMPLE-SIZE INDEPENDENT HEIGHT ADJUSTMENT

CROSS-REFERENCE TO RELATED APPLICATIONS

This application claims the benefit under 35 U.S.C. §119 (e) of U.S. Provisional Application Ser. No. 60/889,621 filed Feb. 13, 2007 and under 35 U.S.C. §119(b) of European Patent Application 07003049.9 filed Feb. 13, 2007.

FIELD OF THE INVENTION

The present invention relates to a device and a method for performing processes and/or reactions that are conducted in a temperature-controlled environment.

BACKGROUND OF THE INVENTION

A thermal cycler for implementing chemical and/or biological reactions comprising a body for accommodating one or more samples and a cover is disclosed, for example, in U.S. Pat. No. 5,475,610. According to one embodiment described therein, once the lid is closed, a torque knob is used to move a platen from a position of no contact with the reaction tubes into a position of contact and to apply a defined pressure onto capped tubes in a reaction block. Therein, it is essential that the caps on the tubes are resiliently deformable. A similar device is disclosed in U.S. Pat. No. 6,703,236. A similar set-up is disclosed in EP 1 013 342. In order to apply a pressure onto the reaction vessels containing a sample, an electrical positioner is actuated so that a movable part of the rigid cover is pressed against the caps of the reaction vessels.

WO 2006/002226 relates to a system for thermal cycling of samples. The system comprises a thermal cycling device having a plurality of cavities adapted to receive at least a portion of a plurality of sample wells and a heated lid. The system of WO '226 further comprises at least one pneumatic driver connected to the heated lid. The pneumatic driver is configured to position the heated lid in a closed position and an open position, and to move the heated lid between the closed position and the open position. The system also comprises at least one pneumatic actuator connected to the pneumatic driver. The pneumatic actuator is configured to actuate the pneumatic driver to automatically position and move the heated lid between the closed position and the open position.

The set-up according to these and similar prior art documents is not well suited to accommodate samples and/or reaction vessels or plates or blocks of different type and/or of different heights (or height tolerances) that are to be used in the same device in subsequent (different) experiments. The travel and the tolerances of the pneumatic drivers or actuators of the prior art are adapted to seal off a specific sample array with reaction vessels of a specific, fixed type and height. Specifically, the travel of the actuator may not be long enough to accommodate and properly seal a reaction vessel of small height and the pressure as exerted by closing the cover may be too high to accommodate a reaction vessel of a large height. In essence, the closing mechanisms of the prior art are not independent of the height of the reaction vessel or the (sample) plate or the (flat) block used to contain a sample or an array of samples.

In view of the prior art in the field, it is an object of the present invention to provide a device and a method according to which various different samples, in particular samples contained in reaction vessels or plates or blocks of different height or of differing height tolerances, can be thermally processed in one and the same device in different experiments. In particular, the pressure as exerted onto the reaction vessels or plates or blocks by means of closing and/or adjusting the means for covering of the device should be as independent of the height of the reaction vessels or plates or blocks as possible.

It is a further object of the present invention to provide a device and a method according to which the at least one sample is covered by said means for covering in a manner so that pressure can be applied as evenly and homogeneously as possible and in a manner so that potential evaporation of the sample or components of the sample is avoided or minimized and/or that condensation of vaporizable fluids of said sample on said means for covering and/or on the caps/lids of reaction vessels (if reaction vessels are used) and/or on the top part of sample wells (if multi-well plates or blocks are used) is minimized or avoided.

Furthermore, it is a preferred object according to the present invention to provide a device and a method that minimize or avoid damage and/or deformation of reaction vessels or plates or blocks during the process of covering the same, in particular damage or deformation caused by applying a pressure onto the reaction vessels or plates or blocks that is too high, or otherwise unsuited for the vessel/plate or block.

SUMMARY OF INVENTION

These and other objects are solved by a device for controlling the temperature of at least one sample comprising at least the following components:

means for accommodating (2) at least one sample;

means for heating and/or cooling (4) at least one sample;

means for covering (3) at least one sample;

wherein the means for covering (3) at least one sample comprise at least one movable contact area (12) and at least one first means (30) for fixating said at least one movable contact area (12) in at least one defined direction relative to the sample, wherein said first means (30) for fixating matingly engages with at least one second means for fixating (31).

It is preferred that said means for fixating are capable of fixating the contact area in a plurality of different positions relative to a potential sample (preferably contained within a reaction vessel/block or plate), wherein said plurality of positions are preferably continuously accessible.

In a preferred embodiment, the means for covering (3) also comprises at least one unlocking device (65) for disengaging at least the first and second means for fixating.

In a preferred embodiment, said defined position is the vertical z-direction, i.e. the movable contact area can be fixated (or locked) in z-direction, further preferably in positive z-direction. The positive z-direction is essentially perpendicular to the sample surface and points away from said sample surface. It is preferred that movement in the opposite direction, i.e. in particular in negative z-direction, is essentially unaffected by said fixation/locking in the (opposite) positive z-direction.

The objects of the present invention are also solved by a process for closing a means for covering (3) in respect to at least one sample comprising at least the following steps:

(i) bringing a movable contact area (12) of a means for covering (3) in physical contact with at least one sample and/or at least one reaction vessel or plate or block containing said at least one sample;

(ii) fixating said movable contact area (12) of the means for covering (3) in the position achieved in step (i) by means of engaging two matable means for fixating (30, 31);

(iii) applying a pressure/force onto the sample and/or reaction vessel(s), plate or block in addition to any potential pressure/force applied during the establishing of physical contact in step (i), wherein said application of pressure/force occurs after having performed step (ii).

In a preferred embodiment, the sample(s) is/are contained in a reaction vessel or in the well/dimple/indentation of a plate or a block and said contact area (12) is brought in physical contact with at least one reaction vessel or plate or block.

It is preferred that means for fixating are capable of fixating the contact area in a plurality of different positions relative to a potential sample (preferably contained within a reaction vessel/block or plate), wherein said plurality of positions are preferably continuously accessible.

It is preferred that said initial pressure/force as exerted onto the reaction vessel(s) after the two matable means for fixating have engaged, i.e. after step (ii) but before step (iii), is zero or close to zero or is given by the weight of the means for covering and is, at any rate, smaller than the final pressure/force as ultimately established after fixating the movable contact area. Furthermore, it is preferred that the weight of the means for covering—or a part thereof—is sufficient to enable any movement of the contact area that is required to establish physical contact between the contact area and the sample or vessel/plate/block, i.e. to perform step (i).

In a further preferred embodiment according to the present invention, at least one of the two means for fixating is movable, preferably in one direction only, relative to the corresponding matable second means for fixating. The second means for fixating is preferably connected to the means for covering. It is preferred that said second means for fixating is not moved (i.e. remains stationary) during the process of closing the means for covering. Alternatively, the second means for fixating is moved in the above-described manner while the first means for fixating remains stationary.

Preferably, the type of movement of the at least two means for fixating relative to each other during the process of fixating [i.e. during step (i)] is selected from a linear or from a circular movement or from any combination of two or more of these movements.

In a preferred embodiment, the two means for fixating matingly engage by means of fitting geometries and/or by means of frictional engagement.

In one preferred embodiment, the at least two matable means for fixating are realized as two matable height adjustment contours which preferably have the contour of a sequence of a plurality of steps with an increasing step height or the contour of an increasing ramp, preferably a linearly increasing ramp (see FIGS. 1 and 2).

In another preferred embodiment, the two matable means for fixating are realized as a frictional catch ("Reibgesperre"). A "frictional catch" in the meaning of the present invention is any means for fixating that temporarily hinders a movable element, preferably the contact area (12), in respect to at least one possible movement in at least one direction. Technical realizations of means for fixating as described in Chapter 9 ("Gehemme und Gesperre") of "*Konstruktionselemente der Feinmechanik*" (Ed.: Werner Krause; ISBN: 3-341-00461-0), pages 445-460 are hereby incorporated by reference.

In a preferred embodiment of the inventive process as described above, step (ii) is conducted so that the movable contact area is fixated only in respect to the movement performed in step (i), preferably in positive vertical z-direction.

In one preferred embodiment in respect to step (iii), at least one movable element (15) of the means for covering is used, after step (ii), to exert a force/pressure onto the sample(s) and/or reaction vessel(s) or plate/block in step (iii) by means of moving the movable element (15) towards the sample(s) or reaction vessel(s) or plate/block, preferably in negative z-direction (see FIGS. 1 and 2).

In another preferred embodiment in respect to step (iii), the movable contact area (12) is deformable and is part of a containment that contains a fluid material or medium, the hydraulic pressure of which is increased so that the contact area (12) exerts (an additional) force/pressure onto the sample and/or reaction vessel or block or plate.

In a preferred embodiment, steps (ii) and (iii) can be coupled so that step (iii) immediately and/or continuously follows step (ii). In a preferred embodiment, steps (i), (ii) and (iii) are integrated in one single continuous movement of the means for covering (3) in one direction. Preferably, said movement in one direction is linear or circular and further preferably involves the movement of at least one part of the means for covering around at least one bearing and/or by at least one pin or pivot point.

Preferably, the fixating as achieved in step (ii) establishes a counterforce (reactio) to any force/pressure (actio) as applied onto the sample/reaction vessel/plate/block in step (iii).

In a preferred process for opening the means for covering (after having closed them), first the pressure/force exerted onto the reaction vessel(s) by means of the movable element (15) or the movable deformable contact area as described above is reduced and/or removed and subsequently the matable means for fixating (30, 31) are disengaged, i.e. steps (ii) and (iii) are reversed, preferably by means of an unlocking device (65) as described above.

Only after these steps, the means for covering are removed, opened or brought out of alignment with the sample, i.e. step (i) is reversed.

The present invention is preferably used for temperature sensitive chemical and biological reactions, preferably in conjunction with nucleic acid amplification, in particular assays based on polymerase chain reactions (PCR). The device of the present invention is particularly suitable as a thermal cycler. It is preferred that both the device and the process are used for thermally cycling at least one sample, preferably two or more samples.

Among the many advantages of the present invention are the following: (a) pressure/force does not need to be exerted directly onto the sample by means of moving an electrical or pneumatic actuator. Rather, force/pressure can be applied onto the sample by means of having all physical units in place and increasing the pressure of a (hydraulic) medium inside a containment and taking advantage of the counterforce (reactio) created by the means for fixating; (b) the application of (hydraulic) pressure onto the sample (and/or any actuation of any movable element if used) is not required until the sample is in physical contact with a contact area of the means for covering; thereby, "idle" application of pressure or actuation is avoided or minimized; (c) as already mentioned above, the device and the method of the present invention allow to use reaction vessels/plates/blocks of different height while the pressure/force as applied upon closing the means for covering is always the same or similar; (d) the force/pressure necessary to ultimately seal the contact area against the sample or vessel/plate/block can be applied at any position of the sample or vessel/plate/block since the means for fixating the contact area relative to the sample can be fixated in a continuous manner only dependent on the height of the vessel/plate/block; (e) in order to perform steps (i) to (iii) of the process according to the present invention, it is sufficient (although by no means required) to establish one continuous movement of the means for covering around one bearing or pin or pivot (see FIG. 3); (f) all of the above can be achieved while evaporation and/or condensation of components of the sample is/are minimized or avoided.

The present invention thus relates to a device and a method for performing processes and/or reactions that are conducted in a temperature-controlled environment. While the present invention is exemplarily discussed in the context of thermal cyclers, the device and method of the invention are not restricted to this specific application but rather relate to all applications known to the person skilled in the art in which some kind of sample(s)/mixture(s) need(s) to be processed at a certain temperature.

Generally, the present invention relates to means for covering one or more sample(s), wherein the means are suitable to avoid or minimize evaporation and/or condensation of any vaporizable substance that may be present in the sample(s) or reaction mixture(s), in particular evaporation of substance at the fringes of a vessel or of an array of vessels. Condensation of a vaporizable substance on the lid of a reaction vessel or a plate/block containing the sample(s) and/or the means for covering should also be avoided or minimized.

Specifically, the present invention relates to a device and a process for closing means of covering onto a sample or reaction vessel or bringing a contact area of the means for covering in physical contact with at least one sample or reaction vessel or a plate or a block and by then fixating said contact area, preferably in respect to the direction the contact area had just been moved to establish physical contact. This fixation should preferably occur prior to applying any further pressure/force onto the at least one sample.

DETAILED DESCRIPTION OF THE INVENTION

Figure 1:
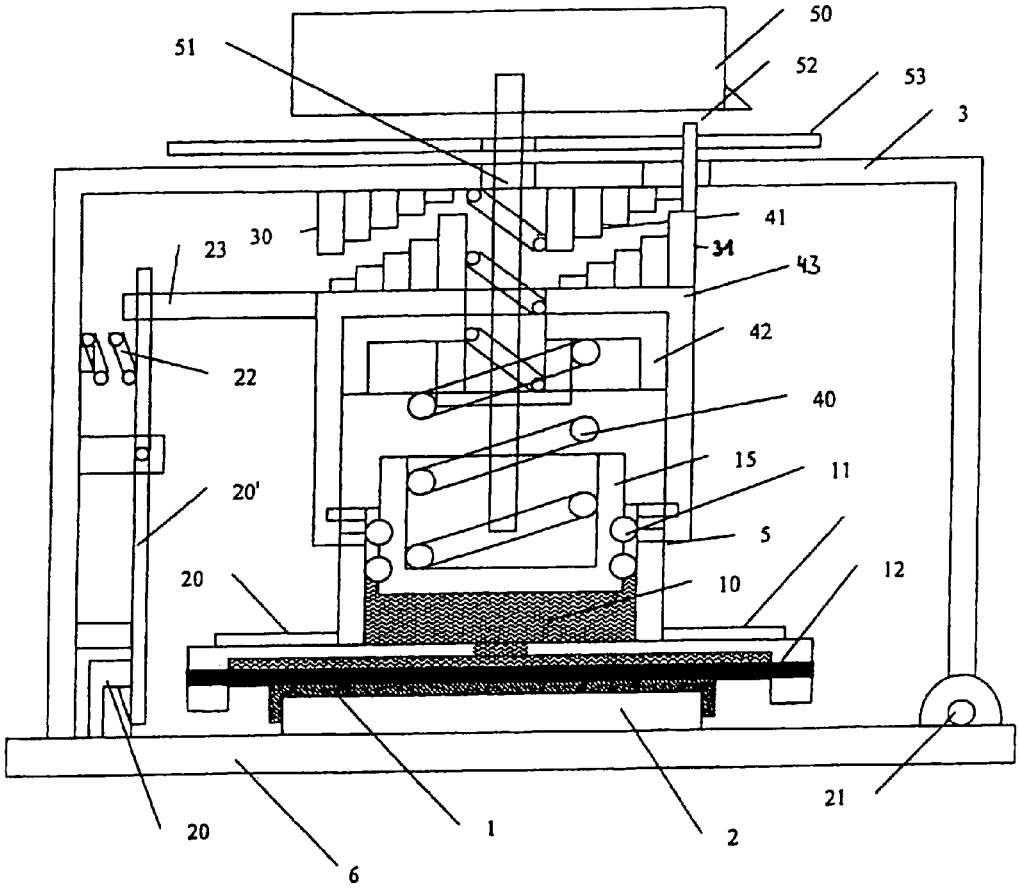
FIG. 1 shows a preferred embodiment according to which the initial position of the contact area (12) relative to the sample (1) is adjusted by means of engaging step-shaped height adjustment contours as the matable means for fixating (30) and (31). A movable element of the means for covering can be used to apply the force as ultimately exerted onto a reaction plate (1) to achieve tight sealing.

In accordance with the present invention, no restrictions exist in regard to the at least one sample. The sample can be a single substance, a reaction mixture or any other conceivable material. Blind samples are included.

In a preferred embodiment, the at least one sample is contained in at least one reaction vessel and/or in at least one well/dimple/indentation of a plate, in particular a sample well plate (micro/multititer plate, PCR plate) or a block, in particular a flat block.

The sample may also be contained in a consumable that is accommodated by a flat block. The reaction vessel, plate or block can be disposable or can be a permanent and/or integral part of the device, in particular of the means for accommodating. In the later case, means for accommodating and reaction vessel/plate/block become one functional unit.

No restrictions exist in regard to the means for accommodating at least one sample. This means may be a holder for reaction vessels or for (disposable) plates or blocks. The means for accommodating as such may also be a block or a plate.

The means for accommodating may be, for example, a (microtiter) plate, a water bath with an insert for holding reaction vessels, a carousel, any other type of multi-well plate or a flat block.

Preferably, the means for accommodating are block-or box-shaped. It is preferred that said means are thermally insulated. It is further preferred that the means for accommodating comprise means for heating and/or cooling the reaction vessel(s) and/or the sample(s) from below and/or from the side.

The means for accommodating may be disposable or may be reusable. They may temporarily or permanently be part of a base body, or of any other part of the device according to the present invention.

No restrictions exist in regard to the reaction vessel(s) or plate or block that optionally contain(s) the at least one sample. In fact, it is a particular advantage of the present invention that different types of reaction vessels or plates or blocks may be used. In particular, the present invention allows for reaction vessels of different height and/or height tolerances. In case a plurality of reaction vessels is arrayed in a plate or a block or any other type of reaction vessel holder, the present invention not only allows for sites in the plate or block or reaction vessel holder to be empty (i.e. to not contain a reaction vessel) but, in fact, provides means for covering that are particularly advantageous for such a setting.

The reaction vessels may be closed (i.e. may have a lid or cover or may be covered by a sheet or a film or a foil) or may be open. According to the present invention, open reaction vessels can be used next to closed reaction vessels. Preferred reaction vessels are reaction tubes as known to the person skilled in the art as suitable for conducting PCR, including vessels having a flat bottom.

No restrictions exist in regard to the means for heating and/or cooling. Preferably, the means are capable of heating or cooling at least one sample and/or at least one reaction vessel or plate or block. It is preferred that the means for heating and/or cooling are selected from the group of resistance heater, fluid mediated heating/cooling, air/gas cooling, Peltier heating/cooling, friction (Joule) heating/cooling, and/or radiation heating.

In a preferred embodiment according to the present invention, at least one means for heating and/or cooling at least one sample and/or reaction vessel or plate or block is part of the means for covering. In this case, it is preferred that said means for heating and/or cooling minimizes or avoids evaporation of sample and/or minimizes or avoids condensation of vaporized sample on or in the vicinity of the means for covering.

It is further preferred, that an (additional) means for heating and/or cooling is provided in the means for accommodating a plurality of samples and/or reaction vessels or the plate or block.

No restrictions exist in regard to the means for covering at least one sample or at least one reaction vessel or the plate/block. The means for covering are preferably temporarily or permanently affixed to and/or aligned with the means for accommodating. In this context, it is preferred that means for covering and the means for accommodating share a common base body. Further preferably, the unit comprising means for accommodating and the means for covering (optionally comprising a base body) completely encloses and/or encases the at least one sample or reaction vessel. Complete enclosing and/or encasing improves temperature stability.

Preferably; the means for covering comprise a locking unit that fixates said means for covering in a pre-determined position. This locking unit is independent of the means for fixating as discussed above.

No restrictions exist in regard to the movable element of the means for covering except that said movable part must be able to exert a force/pressure onto the sample in step (iii) of the process according to the invention. According to a preferred embodiment of the present invention, the movable element is a piston (5) operated hydraulically and/or pneumatically (FIG. 1) or an eccenter disc (FIG. 2). The control of the piston or the disc is preferably achieved electronically in an automated or semi-automated manner. Force/pressure may also be exerted by means of a knob that can be turned, either by hand or by means of an electrical motor. A manually and/or electrically operated actuator and/or spindle is also preferred in that context.

In an alternate embodiment, pressure/force is exerted onto the sample and/or the reaction vessel(s)/plate/block by means of the contact area (12) being deformable and being part of a containment comprising a fluid medium or material (10). Therein, force is exerted by means of increasing the pressure of the medium or material (10) inside the containment.

A preferred embodiment according to the present invention is illustrated in FIG. 1. Therein, a base body (6) supports the means for accommodating (2) realized as a block supporting, in this case, one reaction plate (1).

According to the embodiment shown in FIG. 1, the means for covering (3) are realized as a box-shaped lid that is connected to the base body (6) by means of pivoting means (21) realized as a hinge. The lid (3) can be fixated and aligned in respect to the base body (6) by means of a locking mechanism (20, 20'). In this specific embodiment, the locking mechanism comprises a hook (20') engaging with a corresponding protrusion (20) as attached to the base body (6). Unlocking of said locking mechanism is achieved by means of a spring (22) in conjunction with the movement of an eccentric disc actuator (23).

The height of the contact area (12) relative to the sample plate (1) can be fixated [in accordance with step (ii)] in the position of the closed means for covering (3) as shown in FIG. 1 by two engaging height adjustment contours (30) and (31) as the matable means for fixating. As only a cross-section is shown, the matable height adjustment contours must be visualized as arranged like a "spiral case" along the circumference of a circle. Therefore, by turning knob (50) being connected to (43) via (42), no force is applied onto the sample/plate (1) until the two "spiral cases" matingly engage. During this turning of the knob, the horizontal surfaces of (42) and (43) are in physical contact (as shown in FIG. 1). Once the means for fixating matingly engage and fixate any movement of (43) in positive z-direction, any further turning of knob (50) will lead to a relative vertical movement of (42) away from (43) and, therefore, to the loss of physical contact between the horizontal surfaces of (43) and (42). In this case, turning the knob (50) now will exert a force/pressure onto the sample (1) as mediated by the spring (40).

In the position shown in FIG. 1, first height adjustment contour (30) is connected to the cover (3) and has not yet been moved into mating engagement with the second height adjustment contour (31) that is connected with the connecting frame (43). In this embodiment, contour (31) comprises a pointer (52) that is used in conjunction with a scale (53) to control and/or adjust the position.

The embodiment as shown in FIG. 2 essentially corresponds to the embodiment shown in FIG. 1 with the following notable exceptions. First, the lid (means for covering) (3) is not fixated onto a base body (6) by means of a hinge and a separate locking mechanism but rather by means of a movable rail member (25) attached to the lid (3) that can move freely in one direction in a corresponding rail (24). In this preferred embodiment the final position of the slideable lid (3) is determined by the end of travel of the rail (24).

Figure 2A:
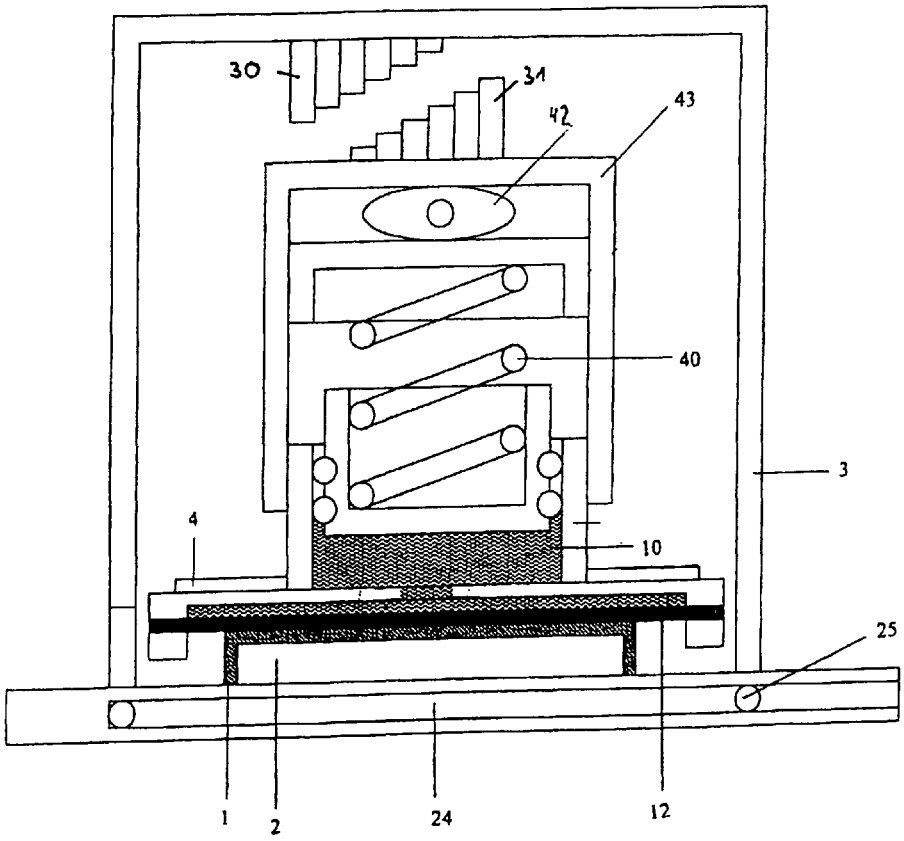
FIG. 2 shows, in a sequence of steps, how first and second height adjustment contours (30, 31) engage, fixate and how afterwards a predetermined pressure is exerted onto the reaction plate/sample.

FIG. 2A shows the position in which the cover/lid (3) is in its final position, aligned t0 with the means for accommodating (2) and the reaction plate (1) by means of the rail member (25) being at the end of travel of rail (24). In this position, the movable contact area (12) has been lowered onto reaction plate (1). In this position, height adjustment contours (30) and (31) do not engage and, consequently, the contact area (12) is not fixated in positive z-direction [step (i) in accordance with the process of the present invention].

Figure 2B:
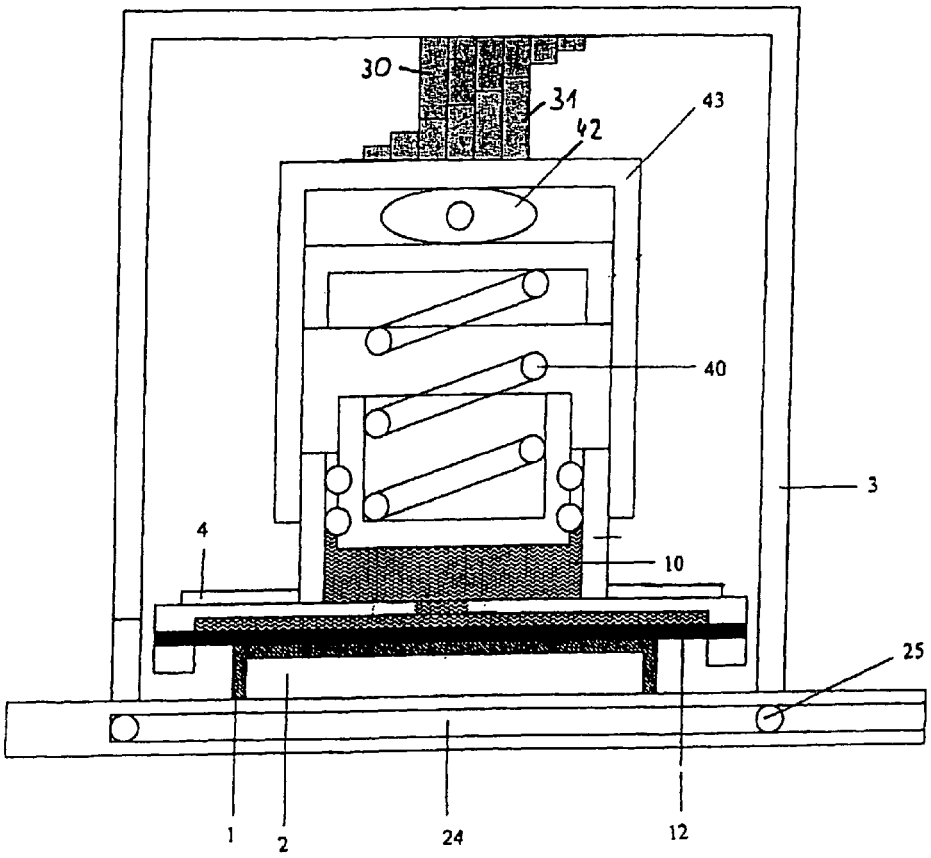

FIG. 2B shows how the height adjustment contours are mutually engaged by means of moving the first height adjustment contour (31) into frictional engagement with the second height adjustment contour (30). This engagement fixates the contact area (12) in positive z-direction, i.e. any pressure exerted onto piston (15) is redirected onto the reaction plate. The number of steps of the step-shaped height adjustment contour (here: four steps) that engage are determined by the height of sample plate (1). This fixating step is in accordance with step (ii) of the process of the present invention.

Figure 2C:
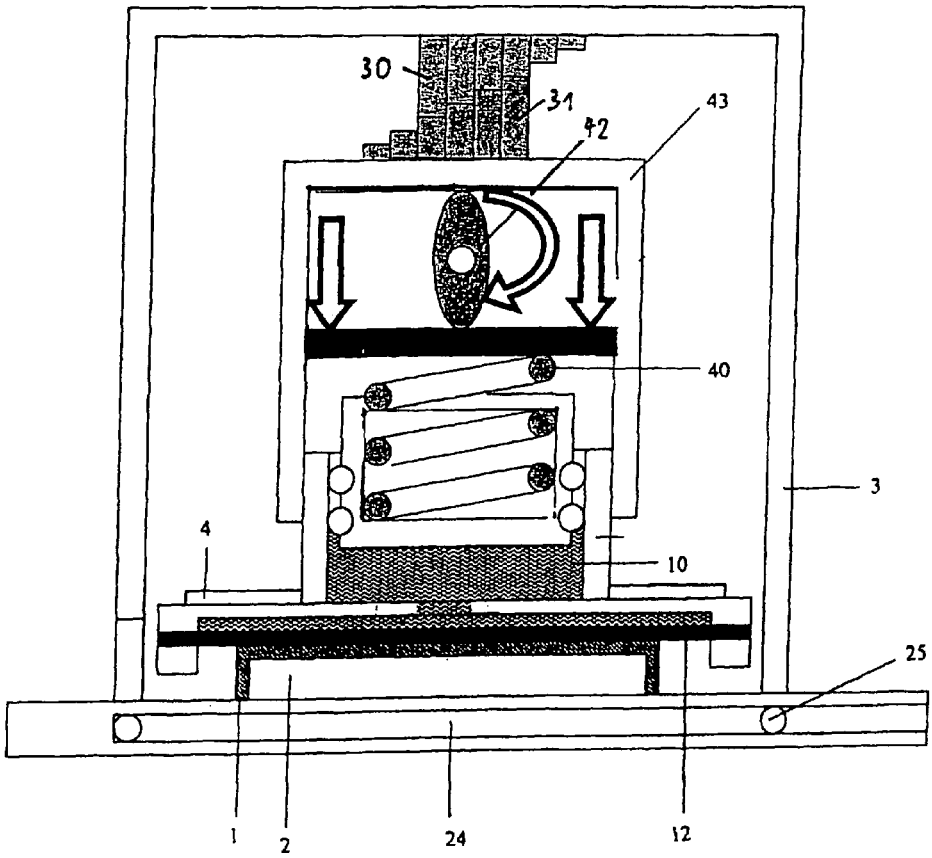

FIG. 2C shows how (additional) pressure is exerted onto the reaction plate (1) in a last step (iii) by means of turning eccentric disc (42) thereby increasing the force as exerted by means of spring (40). The height adjustment contours (means for fixating) remain unchanged in their respective positions in this step.

Figure 3:
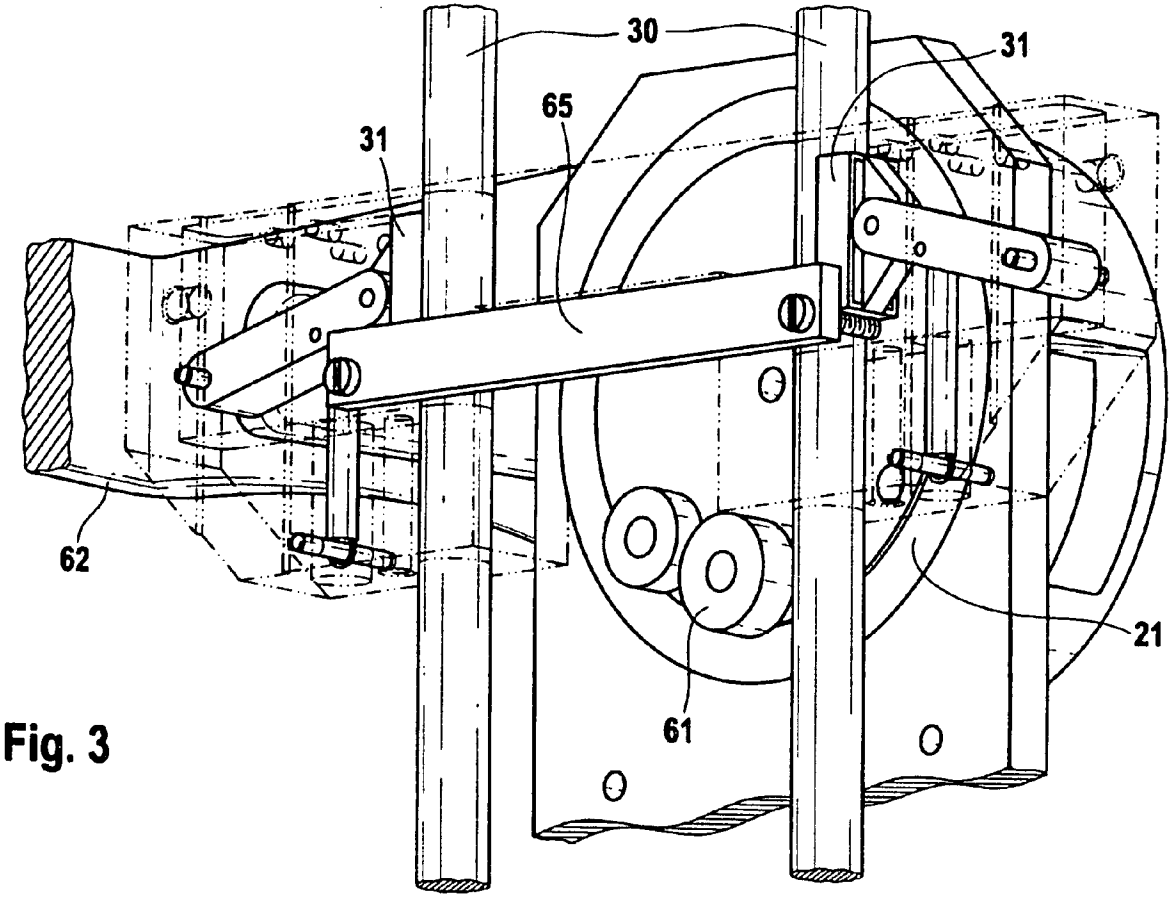
FIG. 3 shows another preferred embodiment according to the present invention in which the means for fixating (30, 31) are realized as a frictional catch.

FIG. 3 shows an alternate embodiment for which the means for fixating (30) and (31) are realized as a frictional catch. Therein, contact area (12) (not shown) is lowered along rods (30) by means of closing the means for covering (not shown) as connected to handle lever (62). The lever (62) pivots around disc (21). A pin (61) is connected to said disc and engages or disengages the brake shoe (31) depending on the position on the lever (62), i.e. the position of the cover (closing or opening).

Once the physical contact between contact area and sample is established, brake shoe (31) frictionally engages with rod (30) thus blocking the positive z-direction, i.e. any upward movement along rod (30).

For unlocking, the movement of the lever (62) is reversed, bringing pin (61) in contact with unlocking bar (65) thus disengaging the brake shoe (31) from the rod (30) and freeing the positive z-direction.

All publications, patents and patent applications cited in this specification are herein expressly incorporated by reference to the same extent as if each individual publication, patent or application was specifically and individually indicated to be incorporated by reference.

The invention now being fully described, it will be apparent to one of ordinary skill in the art that many changes and modifications can be made thereto without departing from the spirit or scope of the appended claims.

REFERENCE SIGNS

1 reaction vessel(s) or reaction plate
2 means for accommodating
3 means for covering
4 means for heating and/or cooling
6 base body
10 fluid medium or material of a containment
12 movable contact area

15 piston (movable element)
20, 20' locking mechanism for means for covering
21 pivoting means of means for covering
22, 23 unlocking mechanism for means for covering
24 rail
25 movable rail member
30 first means for fixating
31 second means for fixating
40, 41 springs
42 spring (pre)loading device
43 connecting frame
50 turning knob
51 shaft
52 pointer
53 scale
61 pin
62 lever (handle)
65 unlocking device

The invention claimed is:

1. Device for controlling the temperature of at least one sample having vaporizable fluids said device comprising at least the following components:

means for accommodating (2) at least one sample, wherein said means for accommodating comprises a reaction vessel, a plate, or a block;

means for heating and/or cooling (4) at least one sample;

means for covering (3) at least one sample;

characterized in that the means for covering (3) at least one sample comprises:

1) at least one movable element (15) for exerting a force onto the means for accommodating (2), wherein the movable element is a piston (5) operated hydraulically and/or pneumatically or an eccentric disc, 2) at least one movable contact area (12) and 3) at least one first means (30) for fixating said at least one movable contact area (12) relative to the sample in a positive vertical z-direction, wherein said first means for fixating (30) matingly engages with at least one second means for fixating (31) to lock said moveable contact area (12) in the positive vertical z-direction and establish a counterforce to any force applied to the means for accommodating (2) in the negative vertical z-direction, and wherein said two means for fixating comprise step-shaped height adjustment contours, which have the contour of a sequence of a plurality of steps and are capable of fixating the contact area in a plurality of different positions relative to the means for accommodating.

2. Device according to claim 1, wherein the means for accommodating (2) at least one sample further comprises a holder for reaction vessels.

3. Device according to claim 2, wherein the reaction vessel is a microtiter plate or a PCR plate.

4. Device according to claim 1, which is suitable as a thermal cycler.

5. Device according to claim 1, wherein the means for fixating the contact area relative to the sample can be fixated in a continuous manner dependent on the height of the means for accommodating.

6. Process for closing a means for covering (3) in respect to at least one sample having vaporizable fluids comprising at least the following steps:

(i) bringing a movable contact area (12) of a means for covering (3) in at least one direction in respect to physical contact with at least one sample and/or means for accommodating said at least one sample, wherein said means for accommodating comprises a reaction vessel, a plate, or a block;

(ii) fixating relative to the sample in a positive vertical z-direction, said movable contact area (12) of the means for covering (3) in the position achieved in step (i) by means of engaging at least two step-shaped height adjustment contours, which have the contour of a sequence of a plurality of steps and are capable of fixating the contact area in a plurality of different positions relative to the means for accommodating, as matable means for fixating (30, 31) to lock said moveable contact area (12) in the positive z-direction and establish a counterforce to any force applied to the sample in the negative vertical z-direction;

(iii) applying a pressure/force onto the means for accommodating by at least one movable element (15), in addition to any potential pressure/force applied during the establishing of physical contact in step (i), wherein said application of pressure/force occurs after having performed step (ii), wherein the movable element is a piston (5) operated hydraulically and/or pneumatically or an eccentric disc.

7. Process according to claim 6, wherein in step (ii), the movable contact area (12) is fixated relative to the direction in respect to which the contact area (12) was moved in step (i), preferably in positive z-direction and, at any rate, wherein said fixating is accomplished prior to step (iii).

8. Process according to claim 6, wherein the initial pressure/force as exerted onto the sample and/or the reaction vessel(s) after the two matable means for fixating (30, 31) have engaged, i.e. after step (ii) but before step (iii), is zero or close to zero and/or is given by the weight of the means for covering (3) and is, at any rate, smaller than the final pressure/force as ultimately established after fixating the movable contact area (12), i.e. after the conclusion of step (iii).

9. Process according to claim 6, wherein steps (ii) and (iii) are coupled so that step (iii) immediately and/or continuously follows step (ii).

10. Process according to claim 6, wherein steps (i), (ii) and (iii) are integrated in one single continuous movement of the means for covering (3), preferably in one direction.

* * * * *